United States Patent [19]

Seymour

[11] Patent Number: 4,772,228

[45] Date of Patent: Sep. 20, 1988

[54] ELECTRICAL CONTACT

[75] Inventor: Douglas G. Seymour, Warren, Pa.

[73] Assignee: GTE Products Corporation, Stamford, Conn.

[21] Appl. No.: 110,900

[22] Filed: Oct. 20, 1987

[51] Int. Cl.[4] ..... H01R 4/18; H01R 13/428

[52] U.S. Cl. ..... 439/709; 439/733; 439/751; 439/865

[58] Field of Search ..... 439/709, 751, 862, 865–867, 439/873, 733, 869

[56] References Cited

U.S. PATENT DOCUMENTS 3,283,291 11/1966 Krol et al. ..... 439/862
3,323,102 5/1967 Minor ..... 439/862
4,166,667 9/1979 Griffin ..... 439/873
4,183,610 1/1980 Key ..... 439/873
4,188,715 2/1980 Ammon et al. ..... 439/751

FOREIGN PATENT DOCUMENTS 2043364 10/1980 United Kingdom ..... 439/751

*Primary Examiner*—Gil Weidenfeld
*Assistant Examiner*—Gary F. Pauman
*Attorney, Agent, or Firm*—William H. McNeill

[57] ABSTRACT

A single beam electrical contact includes an anti-rotation feature as well as a compliant portion for maintaining the contact securely within a housing.

1 Claim, 3 Drawing Sheets

ELECTRICAL CONTACT

This invention relates to electrical connectors and more particularly to an electrical contact for use with such connectors.

BACKGROUND ART

Industry uses vast numbers of high density interconnect contacts for use with subminiature connectors. Such contact systems usually provide dual beams to provide for interconnect stability; however, the dual beam systems decreases the thickness of the beams, occasionally decreasing performance.

SUMMARY OF THE INVENTION

It is, therefore, an object of this invention to obviate the disadvantages of the prior art.

It is another object of the invention to enhance high density connectors.

Yet another object of the invention is the provision of a single beam contact having improved normal force performance on reduced centerline interconnects.

These objects are accomplished, in one aspect of the invention by the provision of an electrical connector which comprises an insulating housing having at least one electrical contact mounted therein. The contact comprises a single contact beam having a rectangular cross-section. The beam tapers from a terminating hertz dot to a transition area. The transition area leads the beam to an anti-rotation section which cooperates with a formed receptive area in the housing. A compliant portion adjacent the anti-rotation section anchors the electrical contact in the housing. A terminator adjacent the compliant portion is formed to receive a wire or other suitable electrical conductor.

BEST MODE FOR CARRYING OUT THE INVENTION

For a better understanding of the present invention, together with other and further objects, advantages and capabilities thereof, reference is made to the following disclosure and appended claim taken in conjunction with the above-described drawings.

Figure 1:
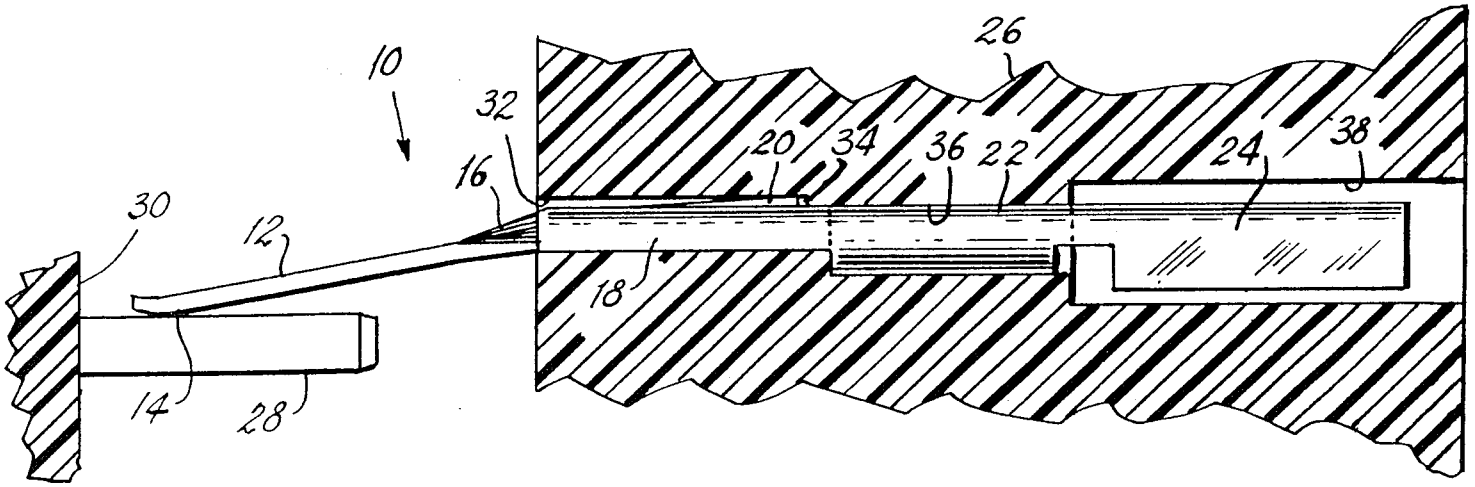
FIG. 1 is an elevational sectional view of an electrical connector and electrical contact according to an embodiment of the invention.
Figures 2, 2A:
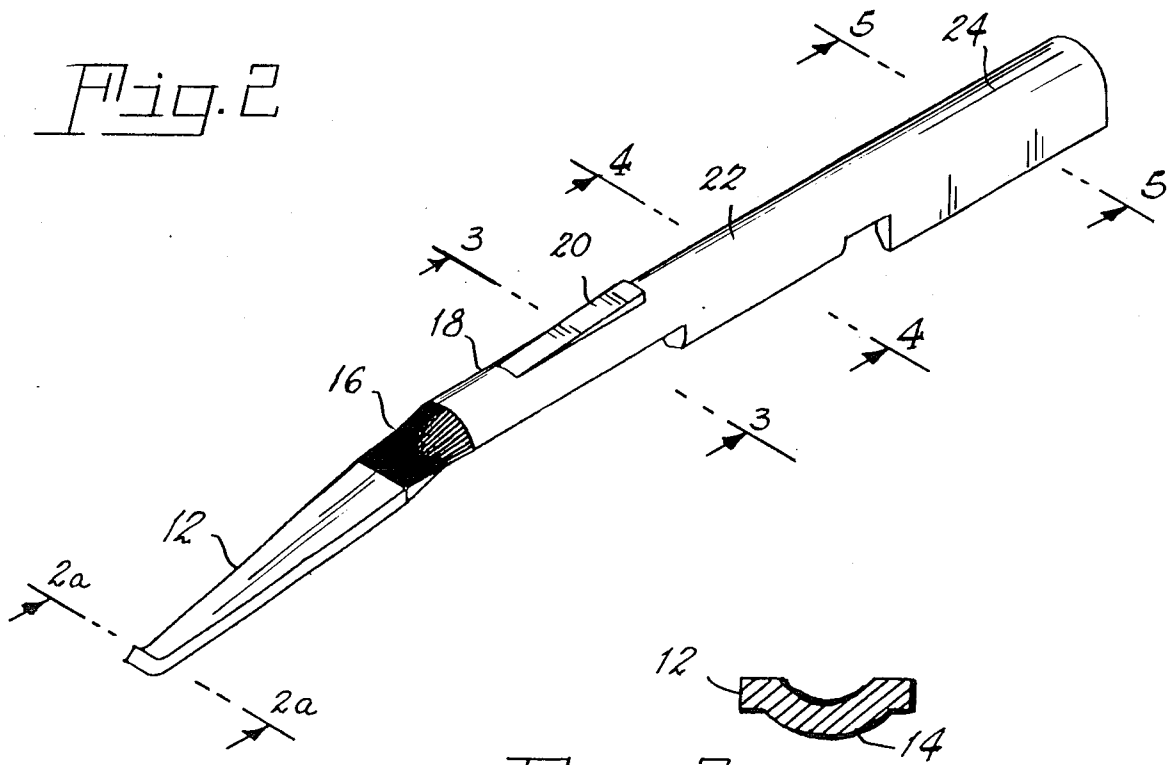
FIG. 2 is a perspective view of the contact of FIG. 1.
FIG. 2*a* is a section along the line 2*a*—2*a* of FIG. 2.
Figure 3:
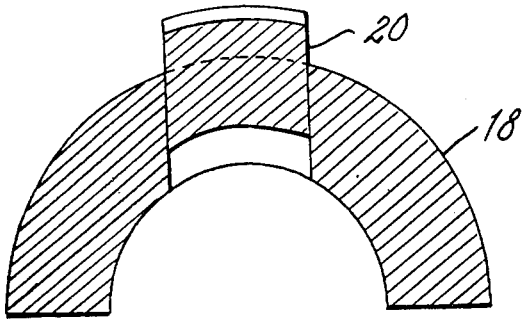
FIG. 3 is a section along the line 3—3 of FIG. 2.

Referring now to the drawings with greater particularity, there is shown in FIG. 2 an electrical contact 10 having a single contact beam 12 with a rectangular cross-section. The beam tapers in a longitudinal direction from a hertz dot 14 (a dimpled portion shown in FIG. 2*a*) to a transition area 16. The transition area leads the rectangular beam to an anti-rotation section 18 which is preferably "U" shaped in cross section (see FIG. 3). A flexible locking tongue 20 is lanced from the bight of the "U" shaped section.

Figure 4:
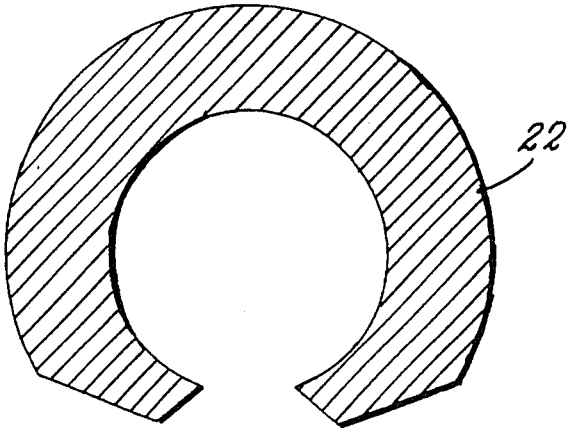
FIG. 4 is a section along the line 4—4 of FIG. 2.

Adjacent to section 18 and contiguous therewith is a compliant portion 22 which preferably is "C" shaped in cross-section (see FIG. 4).

Figure 5:
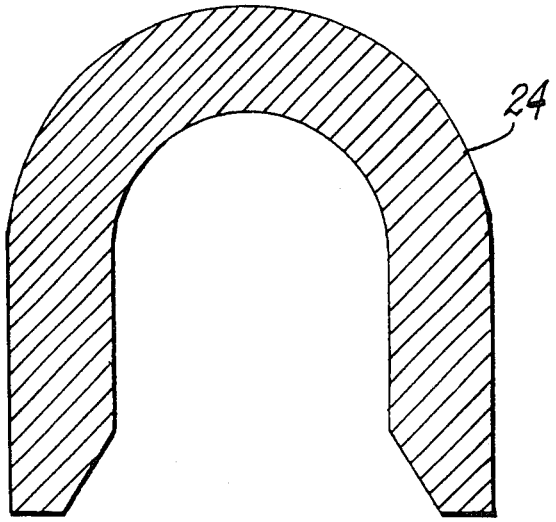
FIG. 5 is a section along the line 5—5 of FIG. 2.

Adjacent to section 22 is a terminator 24 formed to receive a wire or other suitable electrical conductor. As shown, terminator 24 is also a "U" shaped barrel in cross-section (see FIG. 5) and a wire can be soldered or crimped therein; however, terminator 24 can be formed to provide screw means for securing a wire or can be formed to provide an insulation displacement section or other suitable means.

Electrical contact 10 is positioned in an electrically insulating housing 26. As shown, beam 12 and transition area 16 extend beyond housing 26 whereby beam 12 can make electrical connection with a post 28 carried by a header assembly 30.

The anti-rotation section 18 is received in a half-round aperture 32 to achieve its function while the free end of tongue 20 engages the edge 34 of aperture 32 to prevent withdrawal of the contact 10.

Compliant portion 22 is snugly received in a circullar aperture 36 while terminator 24 is contained within an appropriate aperture 38.

There is thus provided a single beam contact with improved stability and improved normal force performance on reduced centerline interconnects. It is rigidly maintained within its housing and shows no tendency to rotate and lose alignment.

While there has been shown and described what is at present considered to be the preferred embodiment of the invention, it will be apparent to those skilled in the art that various changes and modifications can be made herein without departing from the scope of the invention as defined by the appended claim.

I claim:

1. An electrical connector comprising: an insulating housing; and at least one electrical contact mounted in said housing, said contact comprising a single contact beam having a rectangular cross-section and divering from a terminating hertz dot to a transition area, said transition area joining said contact beam to an anti-rotation section which is "U" shaped in cross-section and which cooperates with a formed receptive area in said housing; a compliant portion which is substantially "C" shaped in cross-section adjacent said anti-rotation section which anchors said electrical contact in said housing; and a terminator adjacent said compliant portion, said terminator being in the form of an crimp barrel.

* * * * *